US009458577B2

(12) United States Patent
Rodriguez Martin

(10) Patent No.: US 9,458,577 B2
(45) Date of Patent: Oct. 4, 2016

(54) PROCEDURE FOR CONSTRUCTION OF PAVEMENTS AND RESULTING PAVEMENT

(71) Applicant: Zorutek, S.L.L., Lezo (Guipuzcoa) (ES)

(72) Inventor: Carlos Rodriguez Martin, Lezo (ES)

(73) Assignee: ZORUTEK, S.L.L., Lezo (Guipuzcoa) (ES)

( * ) Notice: Subject to any disclaimer, the term of this patent is extended or adjusted under 35 U.S.C. 154(b) by 0 days.

(21) Appl. No.: 14/613,884

(22) Filed: Feb. 4, 2015

(65) Prior Publication Data

US 2015/0225907 A1 Aug. 13, 2015

(30) Foreign Application Priority Data

Feb. 7, 2014 (ES) ..... 201430159

(51) Int. Cl.

| | |
|---|---|
| ***E01C 5/20*** | (2006.01) |
| ***E01C 11/00*** | (2006.01) |
| ***E01C 9/00*** | (2006.01) |
| ***E01C 5/00*** | (2006.01) |
| ***E01C 5/02*** | (2006.01) |

(52) U.S. Cl.

CPC ..... *E01C 9/002* (2013.01); *E01C 5/003* (2013.01); *E01C 5/02* (2013.01); *E01C 5/20* (2013.01); *E01C 11/00* (2013.01); *E01C 2201/04* (2013.01); *E01C 2201/16* (2013.01)

(58) Field of Classification Search

CPC ..... E01C 5/20; E01C 9/00; E01C 11/00
USPC ..... 404/73
See application file for complete search history.

(56) References Cited

U.S. PATENT DOCUMENTS

| | | | | |
|---|---|---|---|---|
| 3,568,579 | A * | 3/1971 | Hoad et al. | 404/35 |
| 3,890,407 | A * | 6/1975 | Briggs, Jr. | C08F 255/023 525/157 |
| 3,915,582 | A * | 10/1975 | Clarke | 404/75 |
| 3,930,100 | A * | 12/1975 | McDonald | 428/323 |
| 4,113,401 | A * | 9/1978 | McDonald | 404/75 |
| 4,263,419 | A * | 4/1981 | Piestert | C08F 255/023 156/334 |
| 4,684,288 | A * | 8/1987 | Chapa | 404/35 |
| 4,963,055 | A * | 10/1990 | Sims, Jr. | 404/41 |
| 5,183,353 | A * | 2/1993 | Buckelew | 404/69 |
| 5,290,356 | A * | 3/1994 | Frankowski | 106/726 |
| 5,391,226 | A * | 2/1995 | Frankowski | 106/696 |
| 5,630,677 | A * | 5/1997 | Barroso | 404/75 |
| 5,660,498 | A * | 8/1997 | Freeman | 404/17 |
| 8,534,954 | B2 * | 9/2013 | Geary | 404/31 |
| 8,858,115 | B2 * | 10/2014 | Geary | 404/31 |

FOREIGN PATENT DOCUMENTS

| | | | |
|---|---|---|---|
| DE | 8715158 | U1 | 1/1988 |
| WO | WO 99/54552 | A1 | 10/1999 |
| WO | WO 02/095133 | A1 | 11/2002 |

OTHER PUBLICATIONS www.chenso.com/EXTERNAL%20Product%20guides%20%20references/MMA%20references/MMA%20Description.pdf
Chenso Inc., Chemical Engineering Solutions 'Methyl Methacrylate Adhesives Introduction', 2 pages, undated.*

* cited by examiner

*Primary Examiner* — Gary Hartmann
(74) *Attorney, Agent, or Firm* — Lucas & Mercanti, LLP

(57) ABSTRACT

A method of building a pavement includes preparing an asphalt agglomerate support layer upon a substrate to be paved. A thermoplastic liquid resin layer is formed on the asphalt agglomerate support layer. A plurality of tiles is placed on the thermoplastic liquid resin layer, wherein each tile includes at least one thermoplastic resin and at least one aggregate. The plurality of tiles is covered with a layer of finish.

6 Claims, 1 Drawing Sheet

PROCEDURE FOR CONSTRUCTION OF PAVEMENTS AND RESULTING PAVEMENT

CROSS REFERENCE TO RELATED APPLICATION

This Application claims the priority of Spanish Patent Application No. P201430159 filed on Feb. 7, 2014, which is incorporated by reference herein.

OBJECT OF THE INVENTION

The object of the invention refers to a procedure for construction of pavements, and the pavement obtained with this procedure.

In this report, "pavement" refers to any ground covering with the appearance of stones, tiles, cobblestones, shingles and similar, whether in the area of public works (such as for building streets and squares) or in applications in the private sector (such as for building roads, terraces or similar).

The procedure for construction of pavements, according to the invention, prepares an asphalt agglomerate of flexible nature on which a continuous structure is placed that is configured by interjoined tiles; these tiles being of flexible nature, with a thickness of less than 40 millimeters and composed of a thermoplastic resin mixed with at least one aggregate. There is also an impregnation of liquid thermoplastic resin between the support and the continuous structure.

The resulting pavement, according to the construction procedure that is the object of the invention, due to its characteristics (which are described later) is of preferential application on any type of outdoor ground and more particularly, in urban, pedestrian or semi-pedestrian zones that withstand the passage of vehicles.

BACKGROUND OF THE INVENTION

In the current state of the art, the applicant does not know of any history of pavements or procedures for construction of pavements in which the described characteristics concur; even though pavements are known (even with the appearance of stones, tiles, cobblestones, shingles, or similar) utilized in construction: for example, among others, in the documents WO9954552, WO02095133 and DE8715158 some of them are described.

Unresolved problems in these known pavements lie in their low performance (they do not withstand the passage of vehicles over them), and in the difficulties of their installation: stone paving or tiling a street is usually complicated and slow, elevating the costs and inconveniences of the works.

DESCRIPTION OF THE INVENTION

The object of the invention solves this problem. It advocates a new procedure of construction of pavements, and the pavement obtained with this procedure.

The procedure of construction of pavements, according to the invention, is characterized in that, according to it, on the substrate to be paved, a support of asphalt agglomerate of flexible nature is prepared, upon which a continuous structure is placed, configured by interjoined tiles; these tiles being of flexible nature and with little thickness. There is also an impregnation of liquid thermoplastic resin between the support and the continuous structure.

It is also characterized in that in said continuous structure, the tiles are placed according to a specific pattern, and they are obtained in moulds that present a desired finish and different for the portion of pavement to be obtained at any given time.

It is also characterized in that the uncovered face of the continuous structure is covered, impregnated or bathed with one or several coats of finish.

The resulting pavement is a high-performance product with different finishes (according to need) with a much longer life than that of the traditional tiling, cobbling or stone paving in the zones with passage of vehicles. It is characterized in that, being of the type that provide covering of ground with the appearance of stones, tiles, cobblestones, shingles and similar, is configured in preformed and flexible tiles with little thickness, which are a mixture of at least one thermoplastic resin and at least one aggregate.

Included in the object of the invention is the use of tiles with a thickness of less than 40 millimeters that are a mixture of one or several thermoplastic resins and one or several selected aggregates of different grain sizes and/or hardness (according to need).

It is also characterized in that, particularly, the thermoplastic resin used consists of one Methyl Methacrylate Monomer (MMA) and one polyurethane.

The advantages of the procedure of construction of pavements that is object of the invention derive:

- from the flexibility of the components used; thus it adapts with no problem to possible deformations of the substrate and prevents breakage due to settling and dilation;
- from the resistance of the components used; thus, it withstands, with no problem and for a long period of time, both the passage of vehicles and adverse environmental conditions (such as freezes or extreme heat);
- from its simplicity of construction, which allows its quick and continuous "in situ" installation (it does not require dilatation joints).

The advantages of the resulting pavement in accordance with the procedure of construction that is the object of the invention derive:

- from its flexibility, which is very superior to that of any other known pavement;
- from its resistance, which is also very superior to that of the traditional tiling and cobbling;
- from its composition, which allows the making of pavements with different appearances/finishes.

Other configurations and advantages of the invention can be deduced from the following description, and from the subsidiary claims.

DESCRIPTION OF THE DRAWINGS

To understand the object of the invention better, a preferential form of embodiment is represented in the attached figures, subject to accessory changes that do not essentially alter it. In this case.

DESCRIPTION OF A PREFERENTIAL EMBODIMENT

Figure 1:
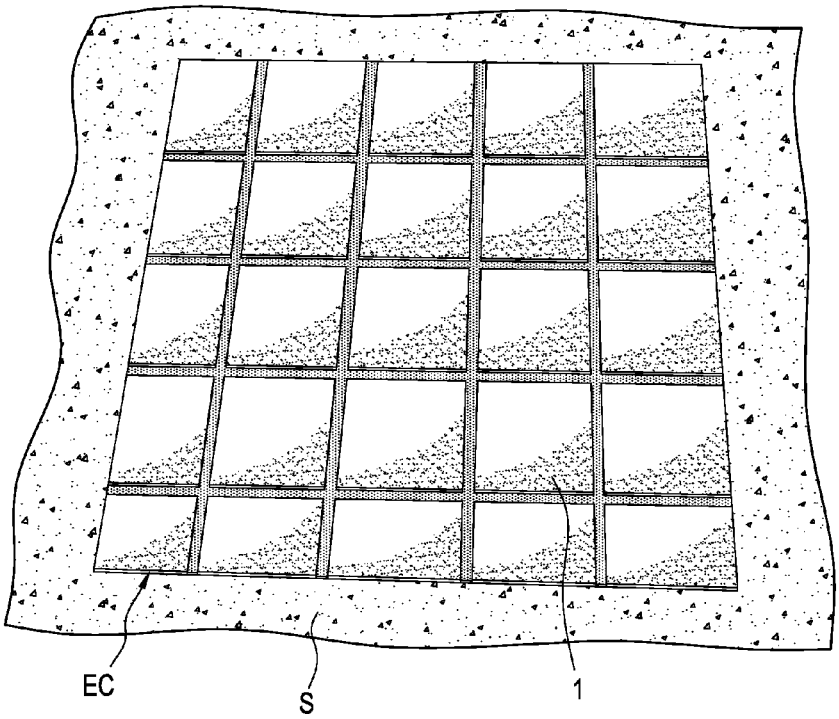
FIG. 1 represents a general schematic view in perspective of a pavement installed according to the procedure that is the object of the invention.

The following is a description of an example of practical, non-limiting embodiment of this invention. Other modes of embodiment in which accessory changes are introduced that do not essentially alter it are in no way ruled out.

The object of the invention is a procedure of construction of pavements and the resulting pavement.

According to the advocated procedure of construction, on the substrate to be paved, a support of asphalt agglomerate (AA) of flexible nature is prepared, upon which a continuous structure (EC) is placed configured by interjoined tiles (1). There is also an impregnation of thermoplastic liquid resin (RL) between the asphalt agglomerate (AA) support below and the continuous structure (EC) on top so that the set of components, after setting, form a continuous and inseparable unit.

The continuous structure (EC) is composed of tiles (1) prepared according to a specific pattern, these tiles (1) being of flexible nature and with little thickness in relation to its total surface. These tiles (1) are obtained in moulds that present a desired finish and different for the portion of pavement to be obtained at any given time.

It is included in the object of the invention that, in addition, the uncovered face of the continuous structure (EC) is covered, impregnated or bathed with one or several coats of finish (2).

The resulting pavement is of the type that provide coverage of ground with the appearance of stones, tiles, cobblestones, shingles or similar and is of preferential application in any type of outdoor ground; particularly in urban, pedestrian or semi-pedestrian zones that withstand the passage of vehicles.

In conformity with the invention, the pavement obtained is configured in tiles (1) that are flexible and with little thickness, which are a mixture of at least one thermoplastic resin (11) and at least one aggregate (12) forming a single whole that is very flexible and with little thickness that is installed, adapting to possible deformations of the substrate to be paved and prevents breakage due to settling and dilatations.

The geometry of these tiles (1) varies according to need, because they are obtained mixing the thermoplastic resins (11) and the aggregates (12) in moulds with the geometry that is to be given to the final product.

The finish can also be varied at will, mixing with thermoplastic resins (11) aggregates (12) of different grain size or hardness, and even of different colours, to obtain tiles (1) with the appearance of natural stone, cobblestone, asphalt, terrazzo, shingles or any other.

In particular, the thermoplastic resin used consists of a Methyl Methacrylate Monomer (MMA) and a polyurethane that gives the preformed portions (1) great resistance and high flexibility (characteristics that have been shown to be particularly suitable for the applications of this pavement).

Specifically, two-component, fast-hardening MMA flexible resin is used, which is frost-resistant, anti-slip and flexible; with a slippage coefficient SRT of between 0.65 and 0.75 depending on the aggregates (2) used.

The aggregates (12) used vary according to the intended use of the pavement: for roads that must resist intense traffic, bauxite quartzes or porphyry are used and for islands, park sidewalks and promenades, marbles are used, which are smoother and more suitable for polishing.

Figure 2:
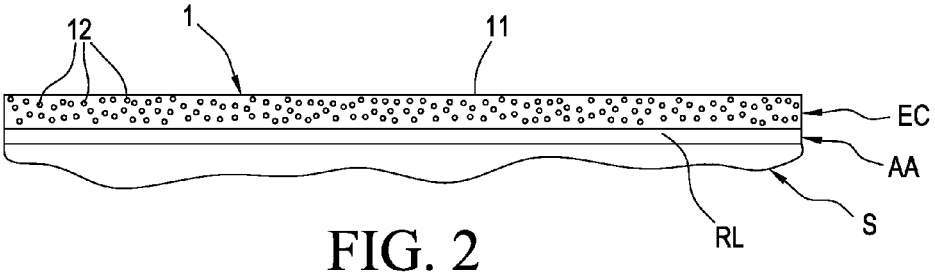
FIG. 2 represents a general schematic cross-section of a pavement, made according to the procedure and using the product object of the invention, in which its structuring and particularities are seen for an example of embodiment.
Figure 3:
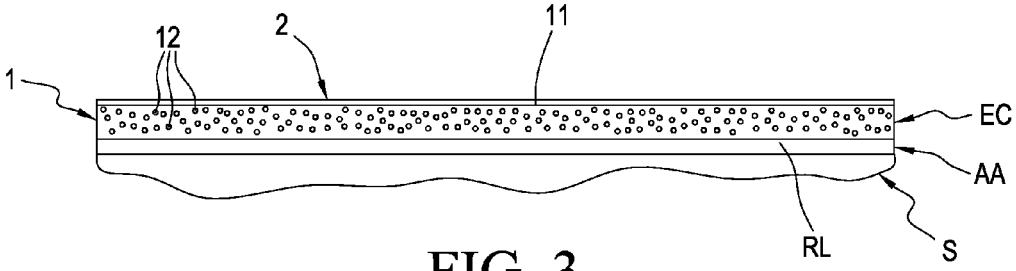
FIG. 3 represents a general schematic cross-section similar to FIG. 2, for an example of alternative embodiment that includes a coat of finish (2).

Included in the object of the invention is the covering of the uncovered face of the tiles (1) with one or several coats of finish (2) that give them additional anti-slip properties. See FIG. 2.

The materials, dimensions, proportions, and in general, those other accessory or secondary details that do not essentially alter, change or modify the proposed object described.

The terms in which this report is written are a true and fair reflection of the object described, and must be taken in their broadest sense, and never in a limiting manner.

The invention claimed is:

1. A method of constructing a pavement, comprising:

a) preparing an asphalt agglomerate support layer;

b) forming a thermoplastic liquid resin layer on the asphalt agglomerate support layer;

c) placing a plurality of tiles on the thermoplastic liquid resin layer, each tile comprising at least one aggregate and at least one thermoplastic resin comprising a Methyl Methacrylate Monomer and a polyurethane; and d) covering the plurality of tiles with a layer of finish.

2. The method of claim 1, wherein the plurality of tiles includes tiles arranged according to a specific pattern.

3. The method of claim 1, wherein the plurality of tiles are obtained in moulds that present a desired finish.

4. The method of claim 1, further comprising:

covering the plurality of tiles with a plurality of layers of finish.

5. A pavement comprising:

an asphalt agglomerate support layer;

a thermoplastic liquid resin layer adjacent to the asphalt agglomerate support layer;

a plurality of tiles disposed on the thermoplastic liquid resin layer, each tile comprising at least one aggregate and at least one thermoplastic resin comprising a Methyl Methacrylate Monomer and a polyurethane; and a layer of finish disposed on the plurality of tiles;

wherein each of the plurality of tiles is of a thickness less than 40 millimeters.

6. The pavement of claim 5, wherein each of the plurality of tiles comprises a mixture of the at least one thermoplastic resin and a plurality of selected aggregates of different grain sizes.

* * * * *